US011118128B2

(12) United States Patent
Sumi et al.

(10) Patent No.: US 11,118,128 B2
(45) Date of Patent: Sep. 14, 2021

(54) ENGINE OIL COMPOSITION

(71) Applicant: ADEKA CORPORATION, Tokyo (JP)

(72) Inventors: Taro Sumi, Tokyo (JP); Shinji Iino, Tokyo (JP)

(73) Assignee: ADEKA CORPORATION, Tokyo (JP)

( * ) Notice: Subject to any disclaimer, the term of this patent is extended or adjusted under 35 U.S.C. 154(b) by 0 days.

(21) Appl. No.: 16/471,704

(22) PCT Filed: Jan. 22, 2018

(86) PCT No.: PCT/JP2018/001795
§ 371 (c)(1),
(2) Date: Jun. 20, 2019

(87) PCT Pub. No.: WO2018/139403
PCT Pub. Date: Aug. 2, 2018

(65) Prior Publication Data

US 2019/0330552 A1 Oct. 31, 2019

(30) Foreign Application Priority Data

Jan. 24, 2017 (JP) ..... JP2017-010505

(51) Int. Cl.
*C10M 135/18* (2006.01)
*C10N 10/12* (2006.01)
(Continued)

(52) U.S. Cl.
CPC .... *C10M 135/18* (2013.01); *C10M 2219/068* (2013.01); *C10N 2010/12* (2013.01);
(Continued)

(58) Field of Classification Search
CPC ..... C10N 2230/02; C10N 2220/022; C10N 2240/102; C10N 2240/104;
(Continued)

(56) References Cited

U.S. PATENT DOCUMENTS 5,916,851 A * 6/1999 Hosonuma ..... C10M 135/00 508/363
6,063,741 A * 5/2000 Naitoh ..... C10M 141/10 508/365
(Continued)

FOREIGN PATENT DOCUMENTS

CN 104870623 8/2015
JP 2001-207184 7/2001
(Continued)

OTHER PUBLICATIONS

International Search Report dated Apr. 3, 2018 in International (PCT) Application No. PCT/JP2018/001795.
(Continued)

*Primary Examiner* — Vishal V Vasisth
(74) *Attorney, Agent, or Firm* — Wenderoth, Lind & Ponack, L.L.P.

(57) ABSTRACT

A fuel-saving-type engine oil composition is provided that exhibits a satisfactory friction-reducing effect in a low-viscosity engine oil without being constrained by, for example, high temperatures, low temperatures, low loads, or high loads. The engine oil composition includes: an engine oil having a low-temperature viscosity of from 0 to 10 in SAE viscosity grades and a high-temperature viscosity of from 4 to 20 in the SAE viscosity grades; and a molybdenum compound (A) represented by the following general formula (1):

[Chemical Formula 1]

(1)

(Continued)

where $R^1$ to $R^4$ each independently represent a hydrocarbon group having 4 to 18 carbon atoms, and not all of $R^1$ to $R^4$ represent the same group, and when $R^1$ and $R^2$ represent the same group, $R^3$ and $R^4$ do not represent the same group, and $X^1$ to $X^4$ each independently represent a sulfur atom or an oxygen atom.

3 Claims, 7 Drawing Sheets

(51) Int. Cl.

| | |
|---|---|
| *C10N 20/02* | (2006.01) |
| *C10N 30/02* | (2006.01) |
| *C10N 30/00* | (2006.01) |
| *C10N 40/25* | (2006.01) |

(52) U.S. Cl.
CPC ..... *C10N 2020/02* (2013.01); *C10N 2030/02* (2013.01); *C10N 2030/54* (2020.05); *C10N 2040/252* (2020.05); *C10N 2040/255* (2020.05)

(58) Field of Classification Search
CPC ..... C10N 2210/06; C10N 2230/54; C10N 2010/12; C10N 2040/25; C10N 2030/54; C10M 2219/068
See application file for complete search history.

(56) References Cited

U.S. PATENT DOCUMENTS

| | | | | |
|---|---|---|---|---|
| 6,562,765 | B1 * | 5/2003 | Boffa | C10M 163/00 508/221 |
| 9,193,931 | B2 * | 11/2015 | Nelson | C10M 135/10 |
| 9,303,229 | B2 * | 4/2016 | Nelson | C10M 141/12 |
| 2012/0145116 | A1 * | 6/2012 | Nelson | C10M 163/00 123/196 R |
| 2015/0344807 | A1 * | 12/2015 | Takeshima | C10M 161/00 508/291 |
| 2016/0130521 | A1 * | 5/2016 | Lerasle | C10M 139/00 508/364 |
| 2016/0312144 | A1 * | 10/2016 | De Barros Bouchet | C10M 141/10 |

FOREIGN PATENT DOCUMENTS

| | | | | |
|---|---|---|---|---|
| JP | 2008-531821 | | 8/2008 | |
| JP | 2011-12213 | | 1/2011 | |
| JP | 2013-133453 | | 7/2013 | |
| JP | 2013-536293 | | 9/2013 | |
| WO | 97/23587 | | 7/1997 | |
| WO | WO-2014076240 | A1 * | 5/2014 | C10M 139/00 |
| WO | WO-2015091466 | A1 * | 6/2015 | C10M 141/10 |

OTHER PUBLICATIONS

English translation of Written Reply to Written Opinion, dated May 9, 2018 in International (PCT) Application No. PCT/JP2018/001795.

* cited by examiner

ENGINE OIL COMPOSITION

This application is a 371 of PCT/JP2018/001795, filed Jan. 22, 2018.

TECHNICAL FIELD

The present invention relates to an engine oil composition that is obtained by blending a low-viscosity engine oil with a specific molybdenum compound serving as an additive for an engine oil, and that exhibits a satisfactory friction-reducing effect.

BACKGROUND ART

The viscosities of engine oils are classified by the viscosity classification of the Society of Automotive Engineers (SAE), and are represented by notations, such as "0W-20" and "5W-30". The number in front of the letter "W" represents the low-temperature viscosity, and a smaller number means that an engine oil hardens less even at low temperatures and is hence superior in cold startability. In addition, the number behind the letter "W" represents the high-temperature viscosity, and a larger number means that the engine oil has a higher viscosity and hence maintains a firmer oil film even at high temperatures. A general low-viscosity engine oil having viscosities represented by any such notation is, for example, an engine oil having a low-temperature viscosity of from 0 to 10 and a high-temperature viscosity of from 4 to 20. When the viscosity of the engine oil at low temperatures is high, particularly in cold districts, its viscous resistance increases to prevent the cranking of an engine, and hence the startability of the engine deteriorates. In addition, when the viscosity of the engine oil at high temperatures is high, its fluid resistance increases and hence the fuel efficiency of the engine deteriorates. Accordingly, a reduction in viscosity of the engine oil has been attracting attention in recent years as a means for achieving lower fuel consumption because of, for example, the following reason. Irrespective of temperature, the reduction improves the startability of the engine, and reduces the fluid resistance of the oil in a fluid lubrication region to improve the friction-reducing effect thereof.

However, reductions in viscosity of engine oil involve, for example, the following extremely large problem. During operation of the engine, the reduction increases the frequency of mixed lubrication and boundary lubrication to increase the number of times of contact between metals, thereby causing damage and deterioration of a machine due to friction, and deterioration of fuel efficiency of the engine. Measures to alleviate the problem, such as the development of an additive for engine oil, have been very strongly demanded from the market.

An organic molybdenum compound well known in the lubricating oil industry is molybdenum dithiocarbamate. Molybdenum dithiocarbamate has heretofore been used as an additive for engine oils that improves the friction-reducing effect of an engine oil in many situations, and its use in a low-viscosity engine oil has also been known. In, for example, Patent Document 1, there is the disclosure of a fuel-saving-type lubricating oil intended for a lubricating oil having an SAE viscosity grade of 0W-20, the lubricating oil being characterized by being blended with a nitrogen-containing ashless dispersant, a metal-containing detergent, molybdenum dithiocarbamate, a phosphorus-containing antiwear agent, an organic antioxidant, and a viscosity index improver. In addition, in Patent Document 2, there is the disclosure of a lubricating oil composition for an internal combustion engine intended for a lubricating oil having an SAE viscosity grade of 0W-20, the composition being characterized by containing a lubricating base oil, an over-based metal-containing detergent, and molybdenum dithiocarbamate serving as a molybdenum-containing friction-reducing agent. Further, in Patent Document 3, there is the disclosure of a lubricant composition for an engine characterized by containing a base oil, a comb-shaped polymer, a nitrogen-containing organic friction modifier, and a molybdenum dithiocarbamate-based compound serving as an organometallic friction modifier, and a low-viscosity engine oil is given as an example of an intended engine oil.

PRIOR ART DOCUMENTS

Patent Document

[Patent Document 1] JP 2011-12213 A
[Patent Document 2] JP 2013-133453 A
[Patent Document 3] JP 2013-536293 A

SUMMARY OF INVENTION

Problem to be Solved by the Invention

Molybdenum dithiocarbamate used in each of the patent Documents exhibits a friction-reducing effect under the conditions of high temperatures and high loads. However, the effect is not sufficient, and there has been a problem in that friction-reducing effects are barely obtained under the conditions of low temperatures and low loads. Various environments, such as high temperatures, low temperatures, low loads, and high loads, are expected in an engine, and hence the development of an additive for an engine oil and an engine oil composition each exhibiting a high friction-reducing effect without being limited by such environments has been required.

Therefore, a problem to be solved by the present invention is to provide a fuel-saving-type engine oil composition that exhibits a satisfactory friction-reducing effect in a low-viscosity engine oil without being constrained by, for example, high temperatures, low temperatures, low loads, or high loads.

Means for Solving the Problem

The inventors of the present invention have made extensive investigations for solving the above-mentioned problem, and as a result, have completed the present invention.

That is, according to one embodiment of the present invention, there is provided an engine oil composition, including: an engine oil having a low-temperature viscosity of from 0 to 10 in SAE viscosity grades and a high-temperature viscosity of from 4 to 20 in the SAE viscosity grades; and a molybdenum compound (A) represented by the following general formula (1):

[Chemical Formula 1]

(1)

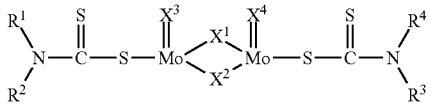

where $R^1$ to $R^4$ each independently represent a hydrocarbon group having 4 to 18 carbon atoms, and not all of $R^1$ to $R^4$ represent the same group, and when $R^1$ and $R^2$ represent the same group, $R^3$ and $R^4$ do not represent the same group, and $X^1$ to $X^4$ each independently represent a sulfur atom or an oxygen atom.

Effects of the Invention

The effect of the present invention is to provide a fuel-saving-type engine oil composition that exhibits a satisfactory friction-reducing effects in a low-viscosity engine oil without being constrained by, for example, high temperatures, low temperatures, low loads, or high loads.

BEST MODE FOR CARRYING OUT THE INVENTION

Figure 1:
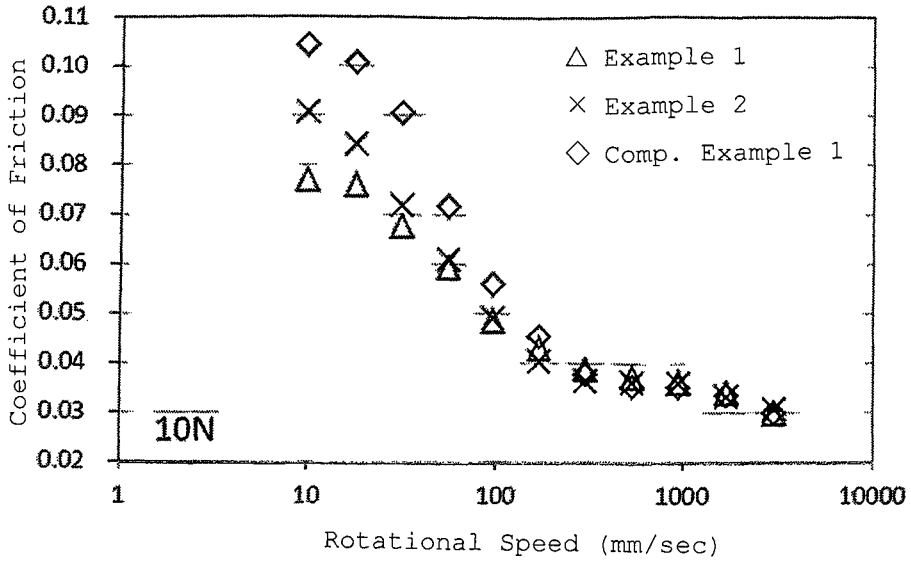
FIG. 1 is a graph for showing a coefficient of friction at each rotational speed at a temperature of 40° C. and a load of 10 N in a MTM test using a 0W-16 engine oil.

An engine oil composition of the present invention includes: an engine oil having a low-temperature viscosity of from 0 to 10 in SAE viscosity grades and a high-temperature viscosity of from 4 to 20 in the SAE viscosity grades; and a molybdenum compound (A) represented by the following general formula (1):

[Chemical Formula 2]

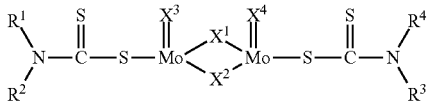

(1)

where $R^1$ to $R^4$ each independently represent a hydrocarbon group having 4 to 18 carbon atoms, and not all of $R^1$ to $R^4$ represent the same group, and when $R^1$ and $R^2$ represent the same group, $R^3$ and $R^4$ do not represent the same group, and $X^1$ to $X^4$ each independently represent a sulfur atom or an oxygen atom.

First, the molybdenum compound (A) to be blended as an additive into the engine oil composition of the present invention is described in detail. In the general formula (1), $R^1$ to $R^4$ each independently represent a hydrocarbon group having 4 to 18 carbon atoms. Examples of such group include: saturated aliphatic hydrocarbon groups such as a n-propyl group, an isopropyl group, a n-butyl group, an isobutyl group, a s-butyl group, a t-butyl group, a n-pentyl group, a branched pentyl group, a sec-pentyl group, a tert-pentyl group, a n-hexyl group, a branched hexyl group, a sec-hexyl group, a tert-hexyl group, a n-heptyl group, a branched heptyl group, a sec-heptyl group, a tert-heptyl group, a n-octyl group, a 2-ethylhexyl group, a branched octyl group, a sec-octyl group, a tert-octyl group, a n-nonyl group, a branched nonyl group, a sec-nonyl group, a tert-nonyl group, a n-decyl group, a branched decyl group, a sec-decyl group, a tert-decyl group, a n-undecyl group, a branched undecyl group, a sec-undecyl group, a tert-undecyl group, a n-dodecyl group, a branched dodecyl group, a sec-dodecyl group, a tert-dodecyl group, a n-tridecyl group, a branched tridecyl group, a sec-tridecyl group, a tert-tridecyl group, a n-tetradecyl group, a branched tetradecyl group, a sec-tetradecyl group, a tert-tetradecyl group, a n-pentadecyl group, a branched pentadecyl group, a sec-pentadecyl group, a tert-pentadecyl group, a n-hexadecyl group, a branched hexadecyl group, a sec-hexadecyl group, a tert-hexadecyl group, a n-heptadecyl group, a branched heptadecyl group, a sec-heptadecyl group, a tert-heptadecyl group, a n-octadecyl group, a branched octadecyl group, a sec-octadecyl group, a tert-octadecyl group and the like; unsaturated aliphatic hydrocarbon groups such as a 1-butenyl group, a 2-butenyl group, a 3-butenyl group, a 1-methyl-2-propenyl group, a 2-methyl-2-propenyl group, a 1-pentenyl group, a 2-pentenyl group, a 3-pentenyl group, a 4-pentenyl group, a 1-methyl-2-butenyl group, a 2-methyl-2-butenyl group, a 1-hexenyl group, a 2-hexenyl group, a 3-hexenyl group, a 4-hexenyl group, a 5-hexenyl group, a 1-heptenyl group, a 6-heptenyl group, a 1-octenyl group, a 7-octenyl group, an 8-nonenyl group, a 1-decenyl group, a 9-decenyl group, a 10-undecenyl group, a 1-dodecenyl group, a 4-dodecenyl group, an 11-dodecenyl group, a 12-tridecenyl group, a 13-tetradecenyl group, a 14-pentadecenyl group, a 15-hexadecenyl group, a 16-heptadecenyl group, a 1-octadecenyl group, a 17-octadecenyl group and the like; aromatic hydrocarbon groups such as a phenyl group, a toluyl group, a xylyl group, a cumenyl group, a mesityl group, a benzyl group, a phenethyl group, a styryl group, a cinnamyl group, a benzhydryl group, a trityl group, an ethylphenyl group, a propylphenyl group, a butylphenyl group, a pentylphenyl group, a hexylphenyl group, a heptylphenyl group, an octylphenyl group, a nonylphenyl group, a decylphenyl group, an undecylphenyl group, a dodecylphenyl group, a styrenated phenyl group, a p-cumylphenyl group, a phenylphenyl group, a benzylphenyl group, an α-naphthyl group, a β-naphthyl group and the like; and alicyclic hydrocarbon groups such as a cyclopropyl group, a cyclobutyl group, a cyclopentyl group, a cyclohexyl group, a cycloheptyl group, a cyclooctyl group, a methylcyclopentyl group, a methylcyclohexyl group, a methylcycloheptyl group, a methylcyclooctyl group, a 4,4,6,6-tetramethylcyclohexyl group, a 1,3-dibutylcyclohexyl group, a norbornyl group, a bicyclo[2.2.2]octyl group, an adamantyl group, a 1-cyclobutenyl group, a 1-cyclopentenyl group, a 3-cyclopentenyl group, a 1-cyclohexenyl group, a 3-cyclohexenyl group, a 3-cycloheptenyl group, a 4-cyclooctenyl group, a 2-methyl-3-cyclohexenyl group, a 3,4-dimethyl-3-cyclohexenyl group and the like. Not all of $R^1$ to $R^4$ represent the same group, and when $R^1$ and $R^2$ represent the same group, $R^3$ and $R^4$ do not represent the same group. Of those, saturated aliphatic hydrocarbon groups and unsaturated aliphatic hydrocarbon groups are preferred because the effect of the present invention is easily obtained and production is easily performed, saturated aliphatic hydrocarbon groups are more preferred, saturated aliphatic hydrocarbon groups having 6 to 15 carbon atoms are still more preferred, and saturated aliphatic hydrocarbon groups having 8 to 13 carbon atoms are even further preferred. In addition, two or more of $R^1$ to $R^4$ still more preferably represent a saturated aliphatic hydrocarbon group having 8 carbon atoms and a saturated aliphatic hydrocarbon group having 10 carbon atoms, or a saturated aliphatic hydrocarbon group having 8 carbon atoms and a saturated aliphatic hydrocarbon group having 13 carbon atoms because the effect of the present invention is more significantly obtained, and two or more of $R^1$ to $R^4$ most preferably represent a 2-ethylhexyl group and an isodecyl group, or a 2-ethylhexyl group and an isotridecyl group.

Examples of the molybdenum compound (A) represented by the general formula (1) include the following compounds:

i) When $R^1$ to $R^4$ represent four kinds of groups

Molybdenum compound (A-I) where $R^1 \neq R^2 \neq R^3 \neq R^4$ ii) When $R^1$ to $R^4$ represent three kinds of groups Molybdenum compound (A-II) where $R^1 = R^2$ and $R^1 \neq R^3 \neq R^4$ Molybdenum compound (A-III) where $R^1 = R^4$ and $R^1 \neq R^2 \neq R^3$ iii) When $R^1$ to $R^4$ represent two kinds of groups Molybdenum compound (A-IV) where $R^1 = R^2 = R^4$ and $R^1 \neq R^3$ Molybdenum compound (A-V) where $R^1 \neq R^2$, $R^1 = R^4$, and $R^2 = R^3$ Those molybdenum compounds (A-I) to (A-V) may be used in combination, or may be used alone, as the molybdenum compound (A) of the present invention. Of those, a molybdenum compound in which $R^1$ to $R^4$ represent two kinds of groups is preferably incorporated as the molybdenum compound (A) of the present invention because the effect of the present invention is easily obtained, and the molybdenum compound (A-IV) and/or the molybdenum compound (A-V) is more preferably incorporated as the molybdenum compound (A) of the present invention, and the molybdenum compound (A-V) is most preferably used alone as the molybdenum compound (A) of the present invention. The mixing ratio of the molybdenum compounds (A-I) to (A-V) when the molybdenum compounds (A-I) to (A-V) are used in combination as the molybdenum compounds (A) of the present invention is not limited.

In the general formula (1), $X^1$ to $X^4$ each independently represent a sulfur atom or an oxygen atom. Of such cases, a case in which $X^1$ and $X^2$ each represent a sulfur atom is preferred because the effect of the present invention is easily obtained, and a case in which $X^1$ and $X^2$ each represent a sulfur atom, and $X^3$ and $X^4$ each represent an oxygen atom is more preferred.

In addition, a method of producing the molybdenum compound (A) represented by the general formula (1) to be used in the present invention is not particularly limited as long as the method is a known production method. The compound may be produced by, for example, a method described in JP S62-81396 A. In other words, the compound may be obtained by: causing molybdenum trioxide or a molybdate and an alkali sulfide or an alkali hydrosulfide to react with each other; then adding carbon disulfide and secondary amines to the resultant; and causing the materials to react with each other at an appropriate temperature. In order to produce the molybdenum compound (A) to be used in the present invention, secondary amines having different hydrocarbon groups, or two or more different kinds of secondary amines only need to be used in the process. In addition to the foregoing, the compound may be produced by using, for example, a production method described in JP H08-217782 A, JP H10-17586 A and the like, and the technical contents of the prior applications are appropriately incorporated as a part hereof.

The engine oil to be used in the engine oil composition of the present invention is an engine oil having a low-temperature viscosity of from 0 to 10 in the SAE viscosity grades and a high-temperature viscosity of from 4 to 20 in the SAE viscosity grades. Although the kind and amount of an additive that has been added to the engine oil are not limited, an engine oil prepared by blending a base oil, and one or two or more kinds selected from the group consisting of an antioxidant, a detergent, a dispersant, a viscosity index improver, and an antiwear agent is preferred because of its ease of availability. The term "SAE viscosity grades" as used herein refers to viscosity standards specified by the Society of Automotive Engineers. With regard to a notation method, the viscosities are represented by, for example, "0W-16" or "0W-20". The number in front of the letter "W" meaning that the engine oil is intended for winter use represents the low-temperature viscosity, and a smaller number means that the oil hardens less even at low temperatures and is hence superior in cold startability. The number behind the letter "W" represents the high-temperature viscosity, and a larger number means that the oil has a higher viscosity and hence maintains a firmer oil film even at high temperatures. A commercial base oil or engine oil having an SAE viscosity grade in the above range may be used as this engine oil, and an engine oil obtained by blending a commercial base oil with one or two or more kinds selected from the group consisting of the antioxidant, the detergent, the dispersant, the viscosity index improver, and the antiwear agent to the extent that the SAE viscosity grade falls within the above range may be used.

Low-temperature viscosities are classified into grades of from 0 to 25 by the values of the cold cranking viscosity (viscosity at which a piston moves up and down) of an engine oil called a cold cranking simulator (CCS) viscosity serving as a guideline on cold startability and the critical viscosity at which the oil can be pumped from an oil pan at a specified temperature called a pumping viscosity, and the low-temperature viscosity of the engine oil to be used in the present invention has a grade of from 0 to 10. Of such grades, a grade of from 0 to 5 is preferred because the effect of the present invention can be easily obtained.

In addition, high-temperature viscosities are classified into grades of from 4 to 60 by the value of a kinematic viscosity (cSt) at 100° C., and the high-temperature viscosity of the engine oil to be used in the present invention has a grade of from 4 to 20. Of such grades, a grade of from 8 to 20 is preferred because the effect of the present invention can be easily obtained, and a grade of from 8 to 16 is more preferred, and a grade of from 12 to 16 is still more preferred.

The base oil for forming the engine oil to be used in the present invention is not particularly limited, and may be appropriately selected from, for example, a mineral base oil, a chemically synthesized base oil, animal and vegetable base oils, a mixed base oil thereof and the like in accordance with its use purposes and use conditions. Here, examples of the mineral base oil include distillates each obtained by distilling, under normal pressure, a paraffin base crude oil, a naphthene base crude oil, or an intermediate base crude oil, or distilling, under reduced pressure, the residual oil of the distillation under normal pressure, and refined oils obtained by refining these distillates in accordance with an ordinary method, specifically a solvent-refined oil, a hydrogenated refined oil, a dewaxed oil, and a clay-treated oil.

Examples of the chemically synthesized base oil include a poly-α-olefin, polyisobutylene (polybutene), a monoester, a diester, a polyol ester, a silicic acid ester, a polyalkylene glycol, polyphenyl ether, a silicone, a fluorinated compound, an alkylbenzene, a GTL base oil and the like. Of those, a poly-α-olefin, polyisobutylene (polybutene), a diester, a polyol ester, and the like can be universally used. Examples of the poly-α-olefin include polymerized forms or oligomerized forms of 1-hexene, 1-octene, 1-nonene, 1-decene, 1-dodecene, 1-tetradecene and the like, or hydrogenated forms thereof. Examples of the diester include diesters of dibasic acids such as glutaric acid, adipic acid, azelaic acid, sebacic acid, dodecanedioic acid and the like, with alcohols such as 2-ethylhexanol, octanol, decanol, dodecanol, tridecanol and the like. Examples of the polyol ester include esters of polyols such as neopentyl glycol, trimethylolethane, trimethylolpropane, pentaerythritol, dipentaerythritol, tripentaerythritol and the like, with fatty acids such as caproic acid, caprylic acid, lauric acid, capric acid, myristic acid, palmitic acid, stearic acid, oleic acid and the like.

Examples of the animal and vegetable base oils include: vegetable oils and fats such as castor oil, olive oil, cacao butter, sesame oil, rice bran oil, safflower oil, soybean oil, camellia oil, corn oil, rapeseed oil, palm oil, palm kernel oil, sunflower oil, cotton seed oil, coconut oil and the like; and animal oils and fats such as beef tallow, lard, milk fat, fish oil, whale oil and the like.

Those various base oils described above may be used alone or in appropriate combination thereof. In addition, the mineral base oil and the chemically synthesized base oil are preferably used because the effect of the present invention can be easily obtained, and the mineral base oil is more preferably used.

The antioxidant that may be blended into the engine oil to be used in the present invention is not particularly limited, and examples thereof include: phenol-based antioxidants such as 2,6-di-tert-butylphenol (tert-butyl is hereinafter abbreviated as t-butyl), 2,6-di-t-butyl-4-methylphenol, 2,6-di-t-butyl-4-ethylphenol, 2,4-dimethyl-6-t-butylphenol, 4,4'-methylenebis(2,6-di-t-butylphenol), 4,4'-bis(2,6-di-t-butylphenol), 4,4'-bis(2-methyl-6-t-butylphenol), 2,2'-methylenebis(4-methyl-6-t-butylphenol), 2,2'-methylenebis(4-ethyl-6-t-butylphenol), 4,4'-butylidenebis(3-methyl-6-t-butylphenol), 4,4'-isopropylidenebis(2,6-di-t-butylphenol), 2,2'-methylenebis(4-methyl-6-cyclohexylphenol), 2,2'-methylenebis(4-methyl-6-nonylphenol), 2,2'-isobutylidenebis(4,6-dimethylphenol), 2,6-bis(2'-hydroxy-3'-t-butyl-5'-methylbenzyl)-4-methylphenol, 3-t-butyl-4-hydroxyanisole, 2-t-butyl-4-hydroxyanisole, stearyl 3-(4-hydroxy-3,5-di-t-butylphenyl)propionate, oleyl 3-(4-hydroxy-3,5-di-t-butylphenyl)propionate, dodecyl 3-(4-hydroxy-3,5-di-t-butylphenyl)propionate, decyl 3-(4-hydroxy-3,5-di-t-butylphenyl)propionate, octyl 3-(4-hydroxy-3,5-di-t-butylphenyl)propionate, tetrakis{3-(4-hydroxy-3,5-di-t-butylphenyl)propionyloxymethyl} methane, 3-(4-hydroxy-3,5-di-t-butylphenyl)propionic acid glycerin monoester, an ester of 3-(4-hydroxy-3,5-di-t-butylphenyl)propionic acid and glycerin monooleylether, 3-(4-hydroxy-3,5-di-t-butylphenyl)propionic acid butylene glycol diester, 3-(4-hydroxy-3,5-di-t-butylphenyl)propionic acid thiodiglycol diester, 4,4'-thiobis(3-methyl-6-t-butylphenol), 4,4'-thiobis(2-methyl-6-t-butylphenol), 2,2'-thiobis(4-methyl-6-t-butylphenol), 2,6-di-t-butyl-α-dimethylamino-p-cresol, 4,6-bis(octylthiomethyl)-o-cresol, 4,6-bis(dodecylthiomethyl)-o-cresol, 2,6-di-t-butyl-4-(N,N'-dimethylaminomethylphenol), bis(3,5-di-t-butyl-4-hydroxybenzyl)sulfide, tris{(3,5-di-t-butyl-4-hydroxyphenyl)propionyl-oxyethyl} isocyanurate, tris(3,5-di-t-butyl-4-hydroxyphenyl)isocyanurate, 1,3,5-tris(3,5-di-t-butyl-4-hydroxybenzyl)isocyanurate, bis{2-methyl-4-(3-n-alkylthiopropionyloxy)-5-t-butylphenyl} sulfide, 1,3,5-tris(4-t-butyl-3-hydroxy-2,6-dimethylbenzyl)isocyanurate, tetraphthaloyl-di(2,6-dimethyl-4-t-butyl-3-hydroxybenzylsulfide), 6-(4-hydroxy-3,5-di-t-butylanilino)-2,4-bis(octylthio)-1,3,5-triazine, 2,2'-thio-diethylenebis[3-(3,5-di-t-butyl-4-hydroxyphenyl) propionate], tridecyl-3-(3,5-di-t-butyl-4-hydroxyphenyl)propionate, pentaerythrityl-tetrakis[3-(3,5-di-t-butyl-4-hydroxyphenyl) propionate], octadecyl-3-(3,5-di-t-butyl-4-hydroxyphenyl)propionate, octyl-3-(3,5-di-t-butyl-4-hydroxyphenyl)propionate, heptyl-3-(3,5-di-t-butyl-4-hydroxyphenyl)propionate, octyl-3-(3-methyl-5-t-butyl-4-hydroxyphenyl)propionate, nonyl-3-(3-methyl-5-t-butyl-4-hydroxyphenyl)propionate, hexamethylenebis[3-(3,5-di-t-butyl-4-hydroxyphenyl)propionate], C7-C9 side chain alkyl esters of [3,5-bis(1,1-dimethyl-ethyl)-4-hydroxy]benzenepropionic acid, 2,4,8-tetraoxaspiro[5,5]undecane-3,9-diylbis(2-methylpropane-2,1-diyl)bis[3-(3,5-di-t-butyl-4-hydroxyphenyl)propionate], 3,5-di-t-butyl-4-hydroxy-benzyl-phosphoric acid diester, bis(3-methyl-4-hydroxy-5-t-butylbenzyl)sulfide, 3,9-bis[1,1-dimethyl-2-{β-(3-t-butyl-4-hydroxy-5-methylphenyl) propionyloxy}ethyl]-2,4,8,10-tetraoxaspiro[5,5]undecane, 1,1,3-tris(2-methyl-4-hydroxy-5-t-butylphenyl)butane, 1,1-bis(2-methyl-4-hydroxy-5-t-butylphenyl)butane, 1,3,5-trimethyl-2,4,6-tris(3,5-di-t-butyl-4-hydroxybenzyl) benzene, 2,4,6-tris(3,5-di-t-butyl-4-hydroxybenzyl)mesitylene, a 3,5-di-t-butyl-4-hydroxybenzylalkyl ester, bis{3,3'-bis-(4'-hydroxy-3'-t-butylphenyl)butyric acid}glycol ester and the like; naphthylamine-based antioxidants such as 1-naphthylamine, phenyl-1-naphthylamine, N-phenyl-1,1,3,3-tetramethylbutylnaphthalen-1-amine, an alkylphenyl-1-naphthylamine, p-octylphenyl-1-naphthylamine, p-nonylphenyl-1-naphthylamine, p-dodecylphenyl-1-naphthylamine, and phenyl-2-naphthylamine; phenylenediamine-based antioxidants, such as N,N'-diisopropyl-p-phenylenediamine, N,N'-diisobutyl-p-phenylenediamine, N,N'-diphenyl-p-phenylenediamine, N,N'-di-β-naphthyl-p-phenylenediamine, N-phenyl-N'-isopropyl-p-phenylenediamine, N-cyclohexyl-N'-phenyl-p-phenylenediamine, N-1,3-dimethylbutyl-N'- phenyl-p-phenylenediamine, dioctyl-p-phenylenediamine, phenylhexyl-p-phenylenediamine, phenyloctyl-p-phenylenediamine and the like; diphenylamine-based antioxidants such as dipyridylamine, diphenylamine, a dialkylphenylamine, bis(4-n-butylphenyl)amine, bis(4-t-butylphenyl)amine, bis(4-n-pentylphenyl)amine, bis(4-t-pentylphenyl)amine, bis(4-n-octylphenyl)amine, bis(4-(2-ethylhexyl)phenyl)amine, bis(4-nonylphenyl)amine, bis(4-decylphenyl)amine, bis(4-dodecylphenyl)amine, bis(4-styrylphenyl)amine, bis(4-methoxyphenyl)amine, 4,4'-bis(α,α-dimethylbenzoyl)diphenylamine, 4-isopropoxydiphenylamine, dipyridylamine, a reaction product of N-phenylbenzenamine with 2,2,4-trimethylpentene and the like; and phenothiazine-based antioxidants such as phenothiazine, N-methylphenothiazine, N-ethylphenothiazine, 3,7-dioctylphenothiazine, a phenothiazinecarboxylic acid ester, phenoselenazine and the like. Of those, it is preferred that the phenol-based antioxidant and the amine-based antioxidant be used in combination because the antioxidants are excellent in function as antioxidants. When any such antioxidant is blended, its blending amount is from 0.01 mass % to 5 mass % with respect to the total amount of the engine oil composition, and is more preferably from 0.05 mass % to 4 mass % because the effect of the present invention can be easily obtained.

The detergent that may be blended into the engine oil to be used in the present invention is not particularly limited, and examples thereof include sulfonates, phenates, salicylates, and phosphates of calcium, magnesium, barium, and boron-modified calcium, overbased salts thereof and the like. Of those, the overbased salts are preferred because of their excellent functions as detergents, and an overbased salt having a total basic number (TBN) of from 10 mgKOH/g to 500 mgKOH/g out of the overbased salts is more preferred. When any such detergent is blended, its blending amount is preferably from 0.5 mass % to 10 mass % with respect to the total amount of the engine oil composition, and is more preferably from 1 mass % to 8 mass % because the effect of the present invention can be easily obtained.

The dispersant that may be blended into the engine oil to be used in the present invention is not particularly limited, and is, for example, a nitrogen-containing compound having at least one linear or branched alkyl group or alkenyl group having 40 to 400 carbon atoms in a molecule thereof, or a derivative thereof. Specific examples thereof include succinimide, succinamide, a succinic acid ester, a succinic acid ester-amide, benzylamine, polyamine, polysuccinimide, a Mannich base and the like, and specific examples of the derivative thereof include products each obtained by subjecting any one of these nitrogen-containing compounds to a reaction with a boron compound such as boric acid, a boric acid salt and the like, a phosphorus compound such as thiophosphoric acid, a thiophosphoric acid salt and the like, an organic acid, a hydroxypolyoxyalkylene carbonate and the like. When the number of carbon atoms of the alkyl group or the alkenyl group is less than 40, the solubility of the compound in the base oil of the engine oil may reduce. On the other hand, when the number of carbon atoms of the alkyl group or the alkenyl group is more than 400, the low-temperature fluidity of the engine oil composition may deteriorate. When any such dispersant is used, its blending amount is preferably from 0.5 mass % to 10 mass % with respect to the total amount of the engine oil composition, and is more preferably from 1 mass % to 8 mass % because the effect of the present invention can be easily obtained.

The viscosity index improver that may be blended into the engine oil to be used in the present invention is not particularly limited, and examples thereof include a poly(C1 to 18)alkyl methacrylate, a (C1 to 18)alkyl acrylate/(C1 to 18)alkyl methacrylate copolymer, a dimethylaminoethyl methacrylate/(C1 to 18)alkyl methacrylate copolymer, an ethylene/(C1 to 18)alkyl methacrylate copolymer, an ethylene/vinyl acetate copolymer, polyisobutylene, a polyalkylstyrene, an ethylene/propylene copolymer, a styrene/maleic acid ester copolymer, a hydrogenated styrene/isoprene copolymer, polyvinyl acetate, an olefin copolymer (OCP), a star polymer and the like. Alternatively, a dispersion-type or multifunctional viscosity index improver to which dispersing performance has been imparted may be used. The weight-average molecular weight of the viscosity index improver is from 10,000 to 1,500,000, and is preferably from about 20,000 to about 500,000 because the function as a viscosity index improver is excellent. When any such viscosity index improver is blended, its blending amount is preferably from 0.1 mass % to 20 mass % with respect to the total amount of the engine oil composition, and is more preferably from 0.3 mass % to 15 mass % because the effect of the present invention can be easily obtained.

The antiwear agent that may be blended into the engine oil of the present invention is not particularly limited, and examples thereof include: sulfur-based additives such as a sulfurized oil and fat, an olefin polysulfide, an olefin sulfide, dibenzyl sulfide, ethyl-3-[[bis(1-methylethoxy)phosphinothioyl]thio]propionate, a tris-[(2 or 4)-isoalkylphenol] thiophosphate, 3-(di-isobutoxy-thiophosphorylsulfanyl)-2-methyl-propionic acid, triphenyl phosphorothionate, β-dithiophosphorylated propionic acid, methylenebis(dibutyl dithiocarbamate), O,O-diisopropyl-dithiophosphorylethyl propionate, 2,5-bis(n-nonyldithio)-1,3,4-thiadiazole, 2,5-bis(1,1,3,3-tetramethylbutanethio)-1,3,4-thiadiazole, 2,5-bis(1,1,3,3-tetramethyldithio)-1,3,4-thiadiazole and the like; phosphorus-based compounds such as monooctyl phosphate, dioctyl phosphate, trioctyl phosphate, monobutyl phosphate, dibutyl phosphate, tributyl phosphate, monophenyl phosphate, diphenyl phosphate, triphenyl phosphate, tricresyl phosphate, monoisopropylphenyl phosphate, diisopropylphenyl phosphate, triisopropylphenyl phosphate, mono-tert-butylphenyl phosphate, di-tert-butylphenyl phosphate, tri-tert-butylphenyl phosphate, triphenyl thiophosphate, monooctyl phosphite, dioctyl phosphite, trioctyl phosphite, monobutyl phosphite, dibutyl phosphite, tributyl phosphite, monophenyl phosphite, diphenyl phosphite, triphenyl phosphite, monoisopropylphenyl phosphite, diisopropylphenyl phosphite, triisopropylphenyl phosphite, mono-tert-butylphenyl phosphite, di-tert-butylphenyl phosphite, tri-tert-butylphenyl phosphite, a phosphorus-based compound represented by the general formula (3) and the like; organometallic compounds such as zinc dithiophosphate (ZnDTP), dithiophosphoric acid metal salts (Sb, Mo, and the like), dithiocarbamic acid metal salts (Zn, Sb, and the like), a naphthenic acid metal salt, a fatty acid metal salt, a phosphoric acid metal salt, a phosphoric acid ester metal salt, a phosphorous acid ester metal salt and the like; thiadiazole compounds and derivatives thereof such as 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3-tetramethylbutyldithio)-1,3,4-thiadiazole, a 2,5-dimercapto-1,3,4-thiadiazole alkyl polycarboxylate, 3,5-bis(n-hexyldithio)-1,2,4-thiadiazole, 3,6-bis(n-octyldithio)-1,2,4-thiadiazole, 3,5-bis(n-nonyldithio)-1,2,4-thiadiazole, 3,5-bis(1,1,3,3-tetramethylbutyldithio)-1,2,4-thiadiazole, 4,5-bis(n-octyldithio)-1,2,3-thiadiazole, 4,5-bis(n-nonyldithio)-1,2,3-thiadiazole, 4,5-bis(1,1,3,3-tetramethylbutyldithio)-1,2,3-thiadiazole, 5,5-dithiobis(1,3,4-thiadiazole-2(3H)-thione) dimercaptothiadia zole, 1,3,4-thiadiazole polysulfide, an alkyl dimercaptothiadiazole and the like; and a boron compound, alkylamine salts of mono- and dihexyl phosphates, a phosphoric acid ester amine salt, and a mixture of a triphenyl thiophosphoric acid ester, a tert-butylphenyl derivative and the like.

[Chemical formula 3]

(3)

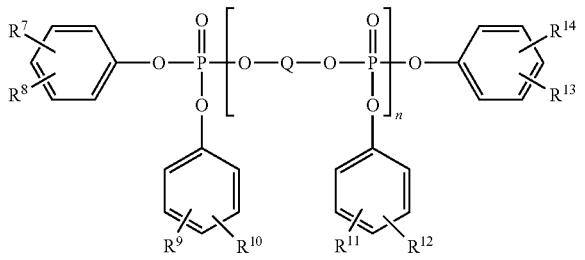

where Q represents a divalent hydrocarbon group having 1 to 20 carbon atoms, "n" represents a number of from 1 to 10, and $R^7$ to $R^{14}$ each independently represent a hydrogen atom or an alkyl group having 1 to 20 carbon atoms.

Of those, an organometallic compound is preferred because of its excellent function as an antiwear agent, and zinc dithiophosphate (ZnDTP) is most preferred. When any such antiwear agent is blended, its blending amount is preferably from 0.01 mass % to 5 mass % with respect to the total amount of the engine oil composition, and is more preferably from 0.05 mass % to 3 mass % because the effect of the present invention can be easily obtained.

Further, the engine oil composition of the present invention may include a molybdenum compound (B) represented by the following general formula (2) in addition to the molybdenum compound (A):

[Chemical formula 4]

(2)

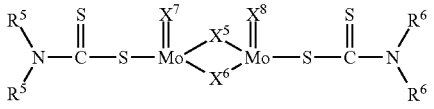

where $R^5$ and $R^6$ each independently represent a hydrocarbon group having 4 to 18 carbon atoms, and $X^5$ to $X^8$ each independently represent a sulfur atom or an oxygen atom.

In the general formula (2), $R^5$ and $R^6$ each represent a hydrocarbon group having 4 to 18 carbon atoms. Examples of such group include: saturated aliphatic hydrocarbon groups such as a n-propyl group, an isopropyl group, a n-butyl group, an isobutyl group, a s-butyl group, a t-butyl group, a n-pentyl group, a branched pentyl group, a sec-pentyl group, a tert-pentyl group, a n-hexyl group, a branched hexyl group, a sec-hexyl group, a tert-hexyl group, a n-heptyl group, a branched heptyl group, a sec-heptyl group, a tert-heptyl group, a n-octyl group, a 2-ethylhexyl group, a branched octyl group, a sec-octyl group, a tert-octyl group, a n-nonyl group, a branched nonyl group, a sec-nonyl group, a tert-nonyl group, a n-decyl group, a branched decyl group, a sec-decyl group, a tert-decyl group, a n-undecyl group, a branched undecyl group, a sec-undecyl group, a tert-undecyl group, a n-dodecyl group, a branched dodecyl group, a sec-dodecyl group, a tert-dodecyl group, a n-tridecyl group, a branched tridecyl group, a sec-tridecyl group, a tert-tridecyl group, a n-tetradecyl group, a branched tetradecyl group, a sec-tetradecyl group, a tert-tetradecyl group, a n-pentadecyl group, a branched pentadecyl group, a sec-pentadecyl group, a tert-pentadecyl group, a n-hexadecyl group, a branched hexadecyl group, a sec-hexadecyl group, a tert-hexadecyl group, a n-heptadecyl group, a branched heptadecyl group, a sec-heptadecyl group, a tert-heptadecyl group, a n-octadecyl group, a branched octadecyl group, a sec-octadecyl group, a tert-octadecyl group and the like; unsaturated aliphatic hydrocarbon groups such as a 1-butenyl group, a 2-butenyl group, a 3-butenyl group, a 1-methyl-2-propenyl group, a 2-methyl-2-propenyl group, a 1-pentenyl group, a 2-pentenyl group, a 3-pentenyl group, a 4-pentenyl group, a 1-methyl-2-butenyl group, a 2-methyl-2-butenyl group, a 1-hexenyl group, a 2-hexenyl group, a 3-hexenyl group, a 4-hexenyl group, a 5-hexenyl group, a 1-heptenyl group, a 6-heptenyl group, a 1-octenyl group, a 7-octenyl group, an 8-nonenyl group, a 1-decenyl group, a 9-decenyl group, a 10-undecenyl group, a 1-dodecenyl group, a 4-dodecenyl group, an 11-dodecenyl group, a 12-tridecenyl group, a 13-tetradecenyl group, a 14-pentadecenyl group, a 15-hexadecenyl group, a 16-heptadecenyl group, a 1-octadecenyl group, a 17-octadecenyl group and the like; aromatic hydrocarbon groups such as a phenyl group, a toluyl group, a xylyl group, a cumenyl group, a mesityl group, a benzyl group, a phenethyl group, a styryl group, a cinnamyl group, a benzhydryl group, a trityl group, an ethylphenyl group, a propylphenyl group, a butylphenyl group, a pentylphenyl group, a hexylphenyl group, a heptylphenyl group, an octylphenyl group, a nonylphenyl group, a decylphenyl group, an undecylphenyl group, a dodecylphenyl group, a styrenated phenyl group, a p-cumylphenyl group, a phenylphenyl group, a benzylphenyl group, an α-naphthyl group, a β-naphthyl group and the like; and alicyclic hydrocarbon groups such as a cyclopropyl group, a cyclobutyl group, a cyclopentyl group, a cyclohexyl group, a cycloheptyl group, a cyclooctyl group, a methylcyclopentyl group, a methylcyclohexyl group, a methylcycloheptyl group, a methylcyclooctyl group, a 4,4,6,6-tetramethylcyclohexyl group, a 1,3-dibutylcyclohexyl group, a norbornyl group, a bicyclo[2.2.2]octyl group, an adamantyl group, a 1-cyclobutenyl group, a 1-cyclopentenyl group, a 3-cyclopentenyl group, a 1-cyclohexenyl group, a 3-cyclohexenyl group, a 3-cycloheptenyl group, a 4-cyclooctenyl group, a 2-methyl-3-cyclohexenyl group, a 3,4-dimethyl-3-cyclohexenyl group and the like. $R^5$ and $R^6$ may represent the same group or different groups. Of those, saturated aliphatic hydrocarbon groups and unsaturated aliphatic hydrocarbon groups are preferred because the effect of the present invention is easily obtained and production is easily performed, saturated aliphatic hydrocarbon groups are more preferred, saturated aliphatic hydrocarbon groups having 6 to 15 carbon atoms are still more preferred, saturated aliphatic hydrocarbon groups having 8 to 13 carbon atoms are even more preferred, and any one of a saturated aliphatic hydrocarbon group having 8 carbon atoms, a saturated aliphatic hydrocarbon group having 10 carbon atoms, and a saturated aliphatic hydrocarbon group having 13 carbon atoms is most preferred. One kind of the molybdenum compound (B) may be blended as the molybdenum compound (B) represented by the general formula (2), or two or more different kinds of the molybdenum compounds (B) may be blended in combination.

In the general formula (2), $X^5$ to $X^8$ each independently represent a sulfur atom or an oxygen atom. Of such cases, a case in which $X^5$ and $X^6$ each represent a sulfur atom is preferred because the effect of the present invention can be easily obtained, and a case in which $X^5$ and $X^6$ each represent a sulfur atom, and $X^7$ and $X^8$ each represent an oxygen atom is more preferred.

A method of producing the molybdenum compound (B) represented by the general formula (2) to be used in the present invention is not particularly limited as long as the method is a known production method. The compound may be produced by using, for example, a production method described in JP S62-81396 A, JP H08-217782 A, JP H10-17586 A and the like, and the technical contents of the prior applications are appropriately incorporated as a part hereof.

Although molybdenum content in the engine oil composition of the present invention is not particularly limited, the content is preferably from 50 ppm by mass to 5,000 ppm by mass because the effect of the present invention can be easily obtained, and the content is more preferably from 80 ppm by mass to 4,000 ppm by mass, still more preferably from 100 ppm by mass to 2,000 ppm by mass, even more preferably from 100 ppm by mass to 1,500 ppm by mass, still even more preferably from 400 ppm by mass to 1,500 ppm by mass, still further even more preferably from 500 ppm by mass to 1,500 ppm by mass, and most preferably from 500 ppm by mass to 1,000 ppm by mass. When the content is less than 50 ppm by mass, the friction-reducing effect of the composition may not be observed. When the content is more than 5,000 ppm by mass, a friction-reducing effect commensurate with the addition amount of molybdenum is not obtained, and the solubility thereof in the engine oil remarkably reduces in some cases. The molybdenum content in the engine oil composition of the present invention is the content of molybdenum derived from the molybdenum compound (A) and the molybdenum compound (B) described in the foregoing. In addition, the engine oil composition of the present invention may include molybdenum derived from a compound except the molybdenum compound (A) and the molybdenum compound (B) described in the foregoing to the extent that the effect of the present invention is not impaired.

Although the molybdenum compound (A) and the molybdenum compound (B) may be blended at any ratio into the engine oil composition of the present invention, the compounds are preferably blended at the following mass ratio because the effect of the present invention can be easily obtained. That is, the compounds are preferably blended at a mass ratio "molybdenum of the molybdenum compound (A):molybdenum of the molybdenum compound (B)" between molybdenum of the molybdenum compound (A) and molybdenum of the molybdenum compound (B) of from 100:0 to 20:80. Of such cases, a case in which the mass ratio "molybdenum of the molybdenum compound (A):molybdenum of the molybdenum compound (B)" is from 100:0 to 40:60 is more preferred because the effect of the present invention can be easily obtained, and a case in which the mass ratio "molybdenum of the molybdenum compound (A):molybdenum of the molybdenum compound (B)" is from 100:0 to 60:40 is still more preferred. When the composition is completely free of the molybdenum compound (A), the effect of the present invention is not obtained, and when the molybdenum compound (A) is blended at a ratio "molybdenum of the molybdenum compound (A): molybdenum of the molybdenum compound (B)" of less than 20:80, a satisfactory friction-reducing effect may not be obtained. In addition, although the effect of the present invention can be obtained even when the molybdenum compound (B) is not blended, in the case where the compound is blended, when the compound is blended at a ratio "molybdenum of the molybdenum compound (A):molybdenum of the molybdenum compound (B)" of more than 20:80, the effect of the present invention may be hard to obtain.

The engine oil composition of the present invention is an engine oil composition obtained by blending an engine oil having a low-temperature viscosity of from 0 to 10 in the SAE viscosity grades and a high-temperature viscosity of from 4 to 20 in the SAE viscosity grades with the molybdenum compound (A) and, as required, the molybdenum compound (B) each serving as an additive for an engine oil, and as described above, the engine oil is preferably an engine oil containing a base oil, and one or two or more kinds selected from the group consisting of an antioxidant, a detergent, a dispersant, a viscosity index improver, and an antiwear agent. However, a mode at the time of the addition of the molybdenum compound (A) and, as required, the molybdenum compound (B) is not particularly limited, and the engine oil composition of the present invention may be produced by post-adding the molybdenum compound (A) and, as required, the molybdenum compound (B) after the production of the engine oil containing the base oil, and one or two or more kinds selected from the group consisting of the antioxidant, the detergent, the dispersant, the viscosity index improver, and the antiwear agent, or the engine oil composition of the present invention may be produced by blending the molybdenum compound (A) and, as required, the molybdenum compound (B) as additives simultaneously with the time of the blending of the base oil with one or two or more kinds selected from the group consisting of the antioxidant, the detergent, the dispersant, the viscosity index improver, and the antiwear agent.

In addition to the base oil, one or two or more kinds of optional components selected from the group consisting of the antioxidant, the detergent, the dispersant, the viscosity index improver, and the antiwear agent, the molybdenum compound (A), and the molybdenum compound (B), any other known engine oil additive may be appropriately used in the engine oil composition of the present invention in accordance with the purpose of use to the extent that the effect of the present invention is not impaired. Examples thereof include a friction modifier, a rust inhibitor, a corrosion inhibitor, a metal deactivator, a defoaming agent and the like. When any such other engine oil additive is blended, one or two or more kinds of compounds may be used, and may be incorporated in a total amount of from 0.005 mass % to 10 mass %, preferably from 0.01 mass % to 5 mass % with respect to the total amount of the engine oil composition.

Any friction modifier may be used as the friction modifier without particular limitation as long as the friction modifier is used for the engine oil composition, and examples thereof include: higher alcohols such as oleyl alcohol, stearyl alcohol, lauryl alcohol and the like; fatty acids such as oleic acid, stearic acid, lauric acid and the like; esters such as glyceryl oleate, glyceryl stearate, glyceryl laurate, an alkyl glyceryl ester, an alkenyl glyceryl ester, an alkynyl glyceryl ester, ethylene glycol oleic acid ester, ethylene glycol stearic acid ester, ethylene glycol lauric acid ester, propylene glycol oleic acid ester, propylene glycol stearic acid ester, propylene glycol lauric acid ester and the like; amides such as oleylamide, stearylamide, laurylamide, an alkylamide, an alkenylamide, an alkynylamide and the like; amines such as oleylamine, stearylamine, laurylamine, an alkylamine, an alkenylamine, an alkynylamine, cocobis(2-hydroxyethyl) amine, tallow bis(2-hydroxyethyl)amine, N-(2-hydroxyhexadecyl)diethanolamine, dimethyl tallow tertiary amine and the like; and ethers such as oleyl glyceryl ether, stearyl glyceryl ether, lauryl glyceryl ether, an alkyl glyceryl ether, an alkenyl glyceryl ether, an alkynyl glyceryl ether and the like. When any such friction modifier is blended, its blending amount is preferably from 0.05 mass % to 5 mass %, more preferably from 0.1 mass % to 3 mass % with respect to the total amount of the engine oil composition.

Any rust inhibitor may be used as the rust inhibitor without particular limitation as long as the rust inhibitor is one used for engine oil compositions. Examples thereof include sodium nitrite, an oxide paraffin wax calcium salt, an oxide paraffin wax magnesium salt, a tallow fatty acid alkali metal salt, an alkaline earth metal salt, an alkaline earth amine salt, an alkenylsuccinic acid, an alkenylsuccinic acid half ester (the molecular weight of the alkenyl group is from about 100 to about 300), a sorbitan monoester, nonylphenol ethoxylate, a lanolin fatty acid calcium salt and the like. When any such rust inhibitor is blended, its blending amount is preferably from 0.01 mass % to 3 mass %, more preferably from 0.02 mass % to 2 mass % with respect to the total amount of the engine oil composition.

Any corrosion inhibitor or metal deactivator may be used as the corrosion inhibitor or the metal deactivator without particular limitation as long as the corrosion inhibitor or the metal deactivator is one used for engine oil compositions. Examples thereof include triazole, tolyltriazole, benzotriazole, benzimidazole, benzothiazole, benzothiadiazole, or derivatives of these compounds, such as 2-hydroxy-N-(1H-1,2,4-triazol-3-yl)benzamide, N,N-bis(2-ethylhexyl)-[(1,2,4-triazol-1-yl)methyl]amine, N,N-bis(2-ethylhexyl)-[(1,2,4-triazol-1-yl)methyl]amine, and 2,2'-[[(4 or 5 or 1)-(2-ethylhexyl)-methyl-1H-benzotriazole-1-methyl]imino]bisethanol; and bis(poly-2-carboxyethyl)phosphinic acid, hydroxyphosphonoacetic acid, a tetraalkylthiuram disulfide, N'1,N'12-bis(2-hydroxybenzoyl)dodecane dihydrazide, 3-(3,5-di-t-butyl-hydroxyphenyl)-N'-(3-(3,5-di-tert-butyl-hydroxyphenyl)propanoyl)propane hydrazide, an esterification product of tetrapropenylsuccinic acid and 1,2-propanediol, disodium sebacate, (4-nonylphenoxy)acetic acid, alkylamine salts of mono- and dihexyl phosphates, a sodium salt of tolyltriazole, (Z)—N-methyl N-(1-oxo-9-octadecenyl) glycine and the like. When any such corrosion inhibitor and metal deactivator are blended, their blending amounts are each preferably from 0.01 mass % to 3 mass %, more preferably from 0.02 mass % to 2 mass % with respect to the total amount of the engine oil composition.

Any defoaming agent may be used as the defoaming agent without particular limitation as long as the defoaming agent is one used for engine oil compositions. Examples thereof include polydimethylsilicone, dimethylsilicone oil, trifluoropropylmethylsilicone, colloidal silica, a polyalkylacrylate, a polyalkylmethacrylate, an alcohol ethoxylate/propoxylate, a fatty acid ethoxylate/propoxylate, a sorbitan partial fatty acid ester and the like. When any such defoaming agent is blended, its blending amount is preferably from 0.001 mass % to 0.1 mass %, more preferably from 0.001 mass % to 0.01 mass % with respect to the total amount of the engine oil composition.

The engine oil composition of the present invention may be used in applications such as gasoline engine oils, diesel engine oils, and the like for automobiles, motorcycles, and the like. The composition is preferably used in a gasoline engine oil application where the effect of the present invention is required to the largest extent and the effect can be easily obtained out of those applications. The engine oil composition of the present invention is not limited by an environment in an engine, such as low temperatures, high temperatures, low loads, or high loads.

An additive for an engine oil of the present invention is an additive for an engine oil including the molybdenum compound (A) represented by the general formula (1). Although the additive for an engine oil of the present invention may include the molybdenum compound (B) represented by the general formula (2) to the extent that the effect of the present invention is not impaired, from the viewpoint of a friction-reducing effect, the compounds are preferably blended at a mass ratio "molybdenum of the molybdenum compound (A):molybdenum of the molybdenum compound (B)" between molybdenum of the molybdenum compound (A) and molybdenum of the molybdenum compound (B) of from 100:0 to 20:80. The mass ratio "molybdenum of the molybdenum compound (A):molybdenum of the molybdenum compound (B)" is more preferably from 100:0 to 40:60, the mass ratio "molybdenum of the molybdenum compound (A):molybdenum of the molybdenum compound (B)" is still more preferably from 100:0 to 60:40, and the additive is most preferably formed only of the molybdenum compound (A).

The additive for an engine oil of the present invention may be used as an additive to, for example, gasoline engine oils, diesel engine oils and the like for automobiles, motorcycles, and the like. The additive is preferably used for gasoline engine oils in which the effect of the present invention is required to the largest extent and the effect can be easily obtained out of such oils. The additive for an engine oil of the present invention exhibits a friction-reducing effect without being constrained by an environment in an engine, such as low temperatures, high temperatures, low loads, or high loads.

In addition, the additive for an engine oil of the present invention can reduce the coefficient of friction of an engine oil having a low-temperature viscosity of from 0 to 10 in the SAE viscosity grades and a high-temperature viscosity of from 4 to 20 in the SAE viscosity grades without being constrained by an environment in an engine, such as low temperatures, high temperatures, low loads, or high loads, when added to the engine oil.

EXAMPLES

Now, the present invention will be specifically described by way of Examples. However, the present invention is by no means limited by these examples, and modifications may be made without departing from the scope of the present invention. In the following Examples and the like, "%" is by mass unless otherwise stated.

Molybdenum Compounds to be Used in Examples and Comparative Examples

Molybdenum compound (A)-1: in the general formula (1), $R^1=R^4=C_8H_{17}$, $R^2=R^3=C_{13}H_{27}$, $X^1$ and $X^2=S$, $X^3$ and $X^4=O$ Molybdenum compound (A)-2: in the general formula (1), $R^1=R^4=C8H_{17}$, $R^2=R^3=C_{10}H_{21}$, $X^1$ and $X^2=S$, $X^3$ and $X^4=O$ Molybdenum compound (B)-1: in the general formula (2), $R^5=R^6=C_8H_{17}$, $X^1$ and $X^2=S$, $X^3$ and $X^4=O$ Molybdenum compound (B)-2: in the general formula (2), $R^5=R^6=C_{13}H_{27}$, $X^1$ and $X^2=S$, $X^3$ and $X^4=O$ Molybdenum compound (B)-3: in the general formula (2), $R^5=C_8H_{17}$, $R^6=C_{13}H_{27}$, $X^1$ and $X^2=S$, $X^3$ and $X^4=O$ Molybdenum compounds to be used in the Examples and Comparative Examples out of the molybdenum compounds (A) and the molybdenum compounds (B) described above are as described below:

Molybdenum Compounds to be used in Examples

Molybdenum compound (A)-1

Molybdenum compound (A)-2

Molybdenum Compounds to be used in Comparative Examples

Molybdenum compound (B)-1

Molybdenum compound (B)': mixture of molybdenum compound (B)-1, molybdenum compound (B)-2, and molybdenum compound (B)-3

Engine Oils to Be Used in Examples and Comparative Examples

A 0W-16 engine oil having a kinematic viscosity at 40° C. of 32.1 $mm^2$/sec, a kinematic viscosity at 100° C. of 7.1 $mm^2$/sec, a VI of 191, and a HTHS viscosity at 150° C. of 2.4 mPa·s (manufactured by Toyota Motor Corporation, Castle 0W-16)

A 0W-12 engine oil having a kinematic viscosity at 40° C. of 26.1 $mm^2$/sec, a kinematic viscosity at 100° C. of 5.9 $mm^2$/sec, a VI of 182, and a HTHS viscosity at 150° C. of 2.1 mPa·s A 5W-30 engine oil having a kinematic viscosity at 40° C. of 60.2 $mm^2$/sec, a kinematic viscosity at 100° C. of 10.5 $mm^2$/sec, a VI of 165, and a HTHS viscosity at 150° C. of 3.1 mPa·s (manufactured by Toyota Motor Corporation, SN-GF5 Castle 5W-30)

Examples 1 to 3 and Comparative Examples 1 to 4

Engine oil compositions 1 to 7 (Examples 1 to 3 and Comparative Examples 1 to 4) were prepared by using the molybdenum compounds and the engine oils described above. Numerical values in Table 1 each represent a molybdenum content (ppm) derived from the molybdenum compound (A) or the molybdenum compound (B) in an engine oil composition, and the respective samples were prepared as the engine oil compositions 1 to 7 by dissolving the molybdenum compounds in the respective engine oils under heat, and returning the temperatures of the solutions to normal temperature.

TABLE 1

| | Example1 | Example2 | Comp. Example1 | Example3 | Comp. Example2 | Comp. Example3 | Comp. Example4 |
|---|---|---|---|---|---|---|---|
| | Engine Oil Composition | | | | | | |
| | 1 | 2 | 3 | 4 | 5 | 6 | 7 |
| Molybdenum compound (A)-1 | 700 | | | 700 | | 700 | |
| Molybdenum compound (A)-2 | | 700 | | | | | |
| Molybdenum compound (B)' | | | 700 | | 700 | | 700 |
| Engine oil 0W-16 | ○ | ○ | ○ | | | | |
| Engine oil 0W-12 | | | | ○ | ○ | | |
| Engine oil 5W-30 | | | | | | ○ | ○ |

<Lubrication Characteristic Evaluation (I)>

A lubrication characteristic evaluation (I) was performed by using the above-mentioned engine oil compositions. In the test, the measurement of a coefficient of friction was performed with an MTM machine (manufactured by PSC Instruments, model: MTM2). A smaller value of the coefficient of friction means that an engine oil composition is superior in friction-reducing effect. In addition, in the measurement of the coefficient of friction described below, a main test was performed after a running-in had been performed at a slide-roll ratio (SRR) of 50% for 2 hours at each load and each temperature in accordance with measurement conditions.

Evaluation in 0W-16 Engine Oil

Figure 2:
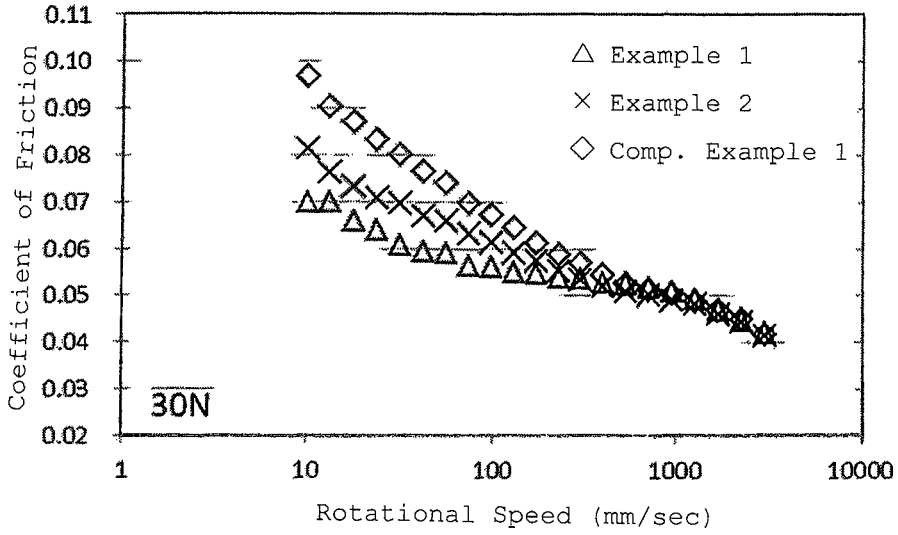
FIG. 2 is a graph for showing a coefficient of friction at each rotational speed at a temperature of 40° C. and a load of 30 N in the MTM test using a 0W-16 engine oil.
Figure 3:
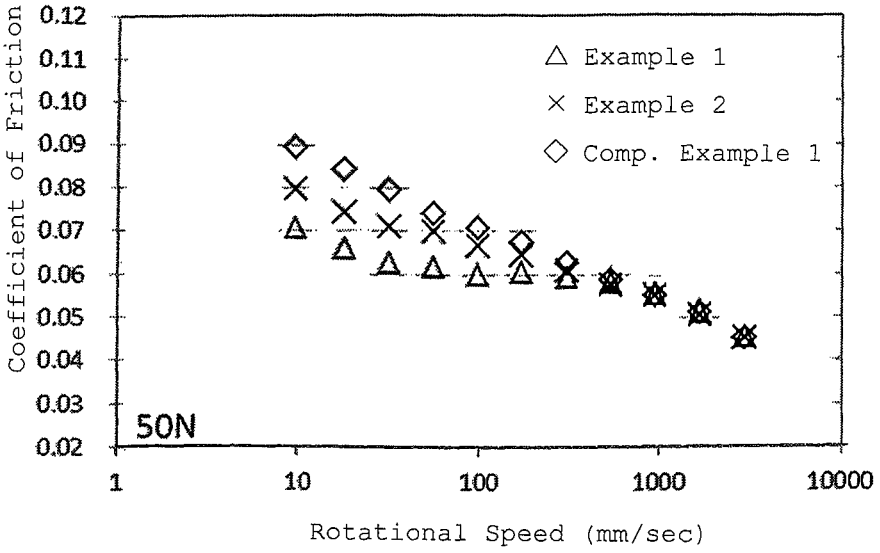
FIG. 3 is a graph for showing a coefficient of friction at each rotational speed at a temperature of 40° C. and a load of 50 N in the MTM test using a 0W-16 engine oil.

First, the test was performed by using the 0W-16 engine oil at a slide-roll ratio (SRR) of 50% and 40° C. The evaluation was performed at a load of 10 N, 30 N, or 50 N, and obtained results are shown in FIG. 1 (load: 10 N), FIG. 2 (load: 30 N), and FIG. 3 (load: 50 N). The axis of abscissa indicates a rotational speed (mm/sec), and the axis of ordinate indicates a coefficient of friction. Results at rotational speeds of from about 10 mm/sec to about 100 mm/sec are evaluation results in mixed and boundary lubrication regions, and results at rotational speeds above 100 mm/sec are evaluation results in a fluid lubrication region. Accordingly, what should be particularly emphasized in the performance evaluations of a low-viscosity engine oil composition and an additive for an engine oil is coefficients of friction at rotational speeds of from about 10 mm/sec to about 100 mm/sec, and this time, the effect of the present invention was confirmed by comparing coefficients of friction at a rotational speed of 20 mm/sec. In Table 2, coefficients of friction at a rotational speed of 20 mm/sec at a load of 10 N, a load of 30 N, and a load of 50 N are shown.

TABLE 2

| | Example 1 Engine Oil Composition 1 | Example 2 Engine Oil Composition 2 | Comparative Example 1 Engine Oil Composition 3 | Engine oil alone |
|---|---|---|---|---|
| Molybdenum compound (A)-1 | 700 | | | |
| Molybdenum compound (A)-2 | | 700 | | |
| Molybdenum compound (B)' | | | 700 | |
| Coefficient of friction 10 N | 0.073 | 0.082 | 0.098 | 0.115 |
| Coefficient of friction 30 N | 0.066 | 0.073 | 0.087 | 0.100 |
| Coefficient of friction 50 N | 0.066 | 0.074 | 0.084 | 0.096 |

It was found from the above-mentioned results that the engine oil composition of the present invention exhibited a friction-reducing effect superior to that of the engine oil composition blended only with the molybdenum compound (B)' (Comparative Example 1) that had heretofore been used, and the composition was not affected by any load. The foregoing means that, with regard to practical problems in a low-viscosity engine oil, each of the molybdenum compound (A)-1 and the molybdenum compound (A)-2 reduced the coefficient of friction of the engine oil, and hence a fuel-saving-type engine oil composition exhibiting a satisfactory friction-reducing effect was obtained.

Figure 4:
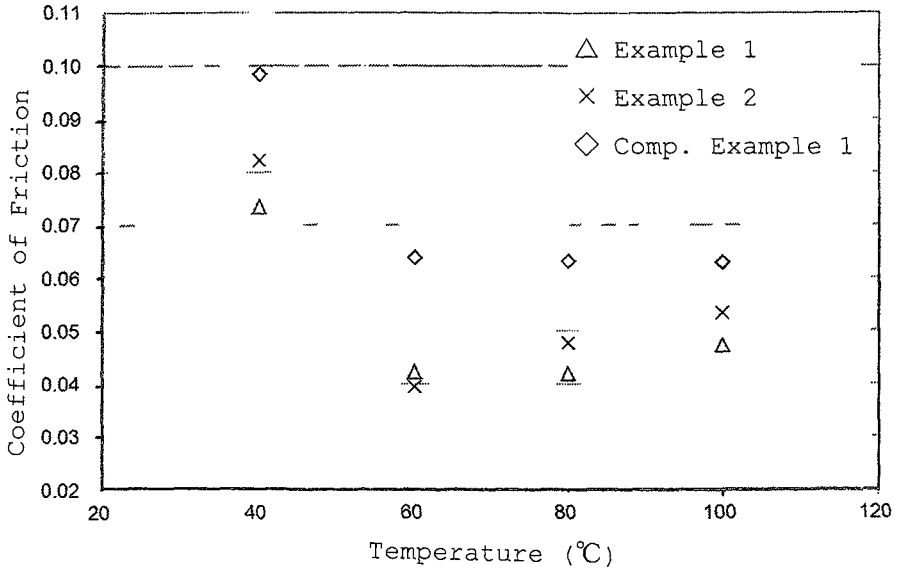
FIG. 4 is a graph for showing a coefficient of friction at each temperature at a rotational speed of 20 mm/sec and a load of 10 N in a MTM test using a 0W-16 engine oil.

According to the above-mentioned results, it was found that the engine oil composition of the present invention provided a friction-reducing effect without being affected by any load. Accordingly, the influence of temperature was examined next. A test was performed by using the 0W-16 engine oil at a rotational speed of 20 mm/sec and a load of 10 N. The results are shown in FIG. 4. The axis of abscissa indicates temperature (° C.), and the axis of ordinate indicates coefficient of friction. The results shown in FIG. 4 are shown in numerical values in Table 3.

TABLE 3

| | Example 1 Engine Oil Composition 1 | Example 2 Engine Oil Composition 2 | Comp. Example 1 Engine Oil Composition 3 | Engine oil alone |
|---|---|---|---|---|
| Molybdenum compound (A)-1 | 700 | | | |
| Molybdenum compound (A)-2 | | 700 | | |
| Molybdenum compound (B)' | | | 700 | |
| Coefficient of friction at 40° C. | 0.073 | 0.082 | 0.098 | 0.115 |
| Coefficient of friction at 60° C. | 0.042 | 0.039 | 0.064 | 0.115 |
| Coefficient of friction at 80° C. | 0.042 | 0.048 | 0.063 | 0.110 |
| Coefficient of friction at 100° C. | 0.047 | 0.053 | 0.063 | 0.087 |

It was found from the above-mentioned results that the engine oil composition of the present invention exhibited a friction-reducing effect superior to that of the engine oil composition blended only with the molybdenum compound (B)' (Comparative Example 1) that had heretofore been used, and the composition was also not affected by any temperature. Accordingly, the engine oil composition of the present invention produced by using the 0W-16 engine oil can be used as an engine oil composition exhibiting a higher friction-reducing effect in applications where the 0W-16 engine oil has heretofore been used.

Evaluation in 0W-12 Engine Oil

Figure 5:
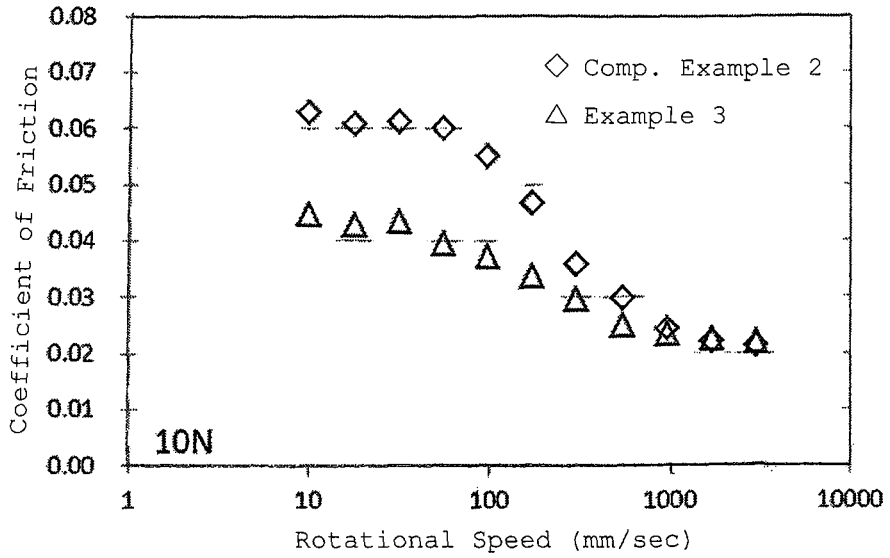
FIG. 5 is a graph for showing a coefficient of friction at each revolution number at a temperature of 40° C. and a load of 10 N in a MTM test using a 0W-12 engine oil.
Figure 6:
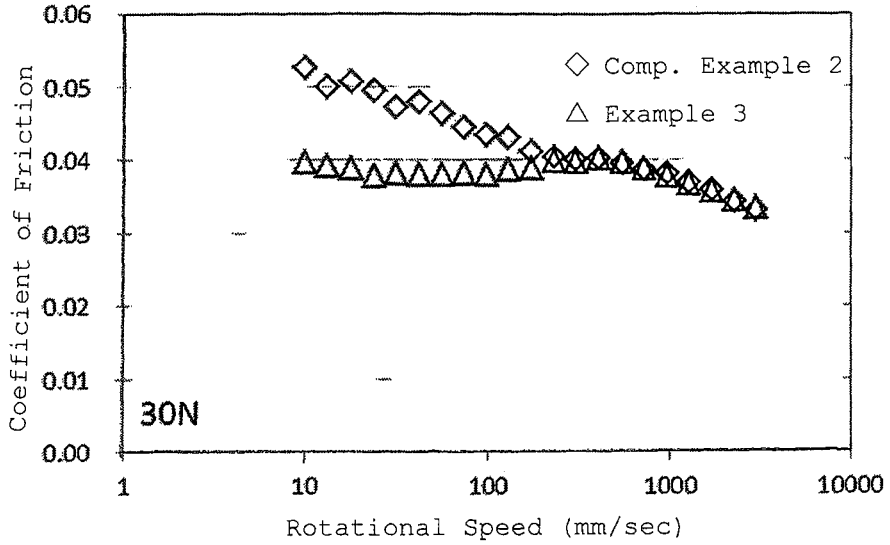
FIG. 6 is a graph for showing a coefficient of friction at each revolution number at a temperature of 40° C. and a load of 30 N in the MTM test using a 0W-12 engine oil.
Figure 7:
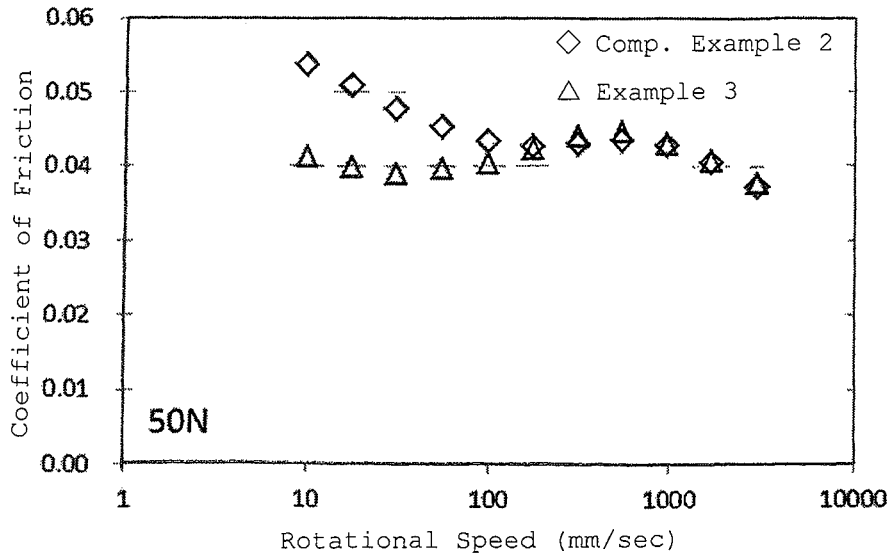
FIG. 7 is a graph for showing a coefficient of friction at each revolution number at a temperature of 40° C. and a load of 50 N in the MTM test using a 0W-12 engine oil.

Next, the test was performed by using the 0W-12 engine oil at a slide-roll ratio (SRR) of 50% and 60° C. The evaluation was performed at a load of 10 N, 30 N, or 50 N, and the obtained results are shown in FIG. 5 (load: 10 N), FIG. 6 (load: 30 N), and FIG. 7 (load: 50 N). The axis of abscissa indicates rotational speed (mm/sec), and the axis of ordinate indicates coefficient of friction. As in the evaluation in the 0W-16 engine oil, the effect of the present invention was confirmed by comparing coefficients of friction at a rotational speed of 20 mm/sec. In Table 4, coefficients of friction at a rotational speed of 20 mm/sec at a load of 10 N, a load of 30 N, and a load of 50 N are shown.

TABLE 4

| | Example 3 Engine Oil Composition 4 | Comp. Example 2 Engine Oil Composition 5 | Engine oil alone |
|---|---|---|---|
| Molybdenum compound (A)-1 | 700 | | |
| Molybdenum compound (A)-2 | | | |
| Molybdenum compound (B)' | | 700 | |
| Coefficient of friction 10 N | 0.044 | 0.062 | 0.141 |
| Coefficient of friction 30 N | 0.039 | 0.051 | 0.137 |
| Coefficient of friction 50 N | 0.040 | 0.051 | 0.133 |

It was found from the above-mentioned results that, even in the case where the 0W-12 engine oil was used, as in the case where the 0W-16 engine oil was used, the engine oil composition of the present invention exhibited a friction-reducing effect superior to that of the engine oil composition blended only with the molybdenum compound (B)' (Comparative Example 2) that had heretofore been used, and the composition was not affected by any load.

Figure 8:
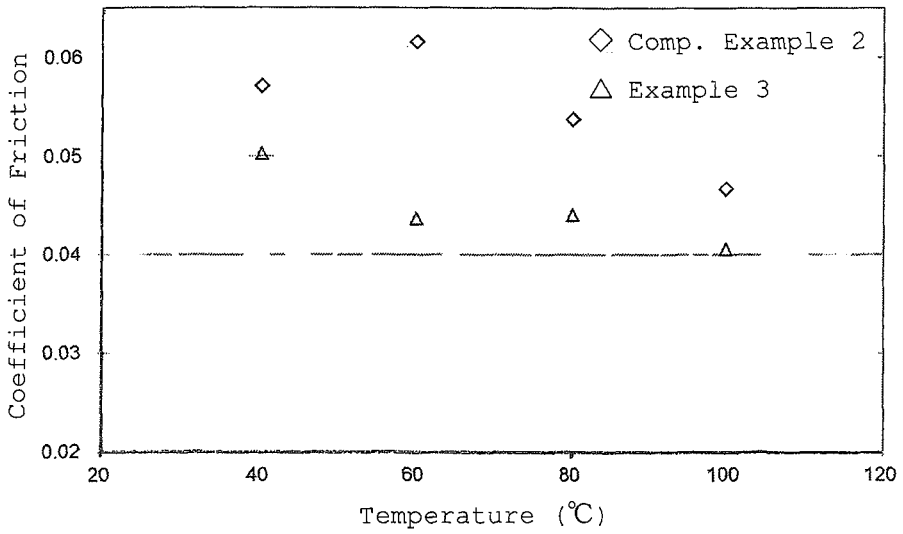
FIG. 8 is a graph for showing a coefficient of friction at each temperature at a rotational speed of 20 mm/sec and a load of 10 N in a MTM test using a 0W-12 engine oil.

It was found from the above-mentioned experiment, as in the case where the 0W-16 engine oil was used, the engine oil composition of the present invention provided a friction-reducing effect without being affected by any load even in the case where the 0W-12 engine oil was used. Accordingly, the influence of temperature was examined next. A test was performed by using the 0W-12 engine oil at a rotational speed of 20 mm/sec and a load of 10N. The results are shown in FIG. 8. The axis of abscissa indicates temperature (° C.), and the axis of ordinate indicates coefficient of friction. The results shown in FIG. 8 are shown in numerical values in Table 5.

TABLE 5

| | Example 3 Engine Oil Composition 4 | Comp. Example 2 Engine Oil Composition 5 | Engine oil alone |
|---|---|---|---|
| Molybdenum compound (A)-1 | 700 | | |
| Molybdenum compound (A)-2 | | | |
| Molybdenum compound (B)' | | 700 | |
| Coefficient of friction at 40° C. | 0.050 | 0.057 | 0.141 |
| Coefficient of friction at 60° C. | 0.044 | 0.062 | 0.139 |
| Coefficient of friction at 80° C. | 0.044 | 0.054 | 0.141 |
| Coefficient of friction at 100° C. | 0.041 | 0.047 | 0.136 |

It was found from the above-mentioned results that, as in the case where the 0W-16 engine oil was used, the engine oil composition of the present invention exhibited a friction-reducing effect superior to that of the engine oil composition blended only with the molybdenum compound (B)' (Comparative Example 2) that had heretofore been used, and the composition was also not affected by any temperature. Accordingly, the engine oil composition of the present invention produced by using the 0W-12 engine oil can be used as an engine oil composition exhibiting a higher friction-reducing effect in an application where the 0W-12 engine oil has heretofore been used.

Evaluation in 5W-30 Engine Oil

Figure 9:
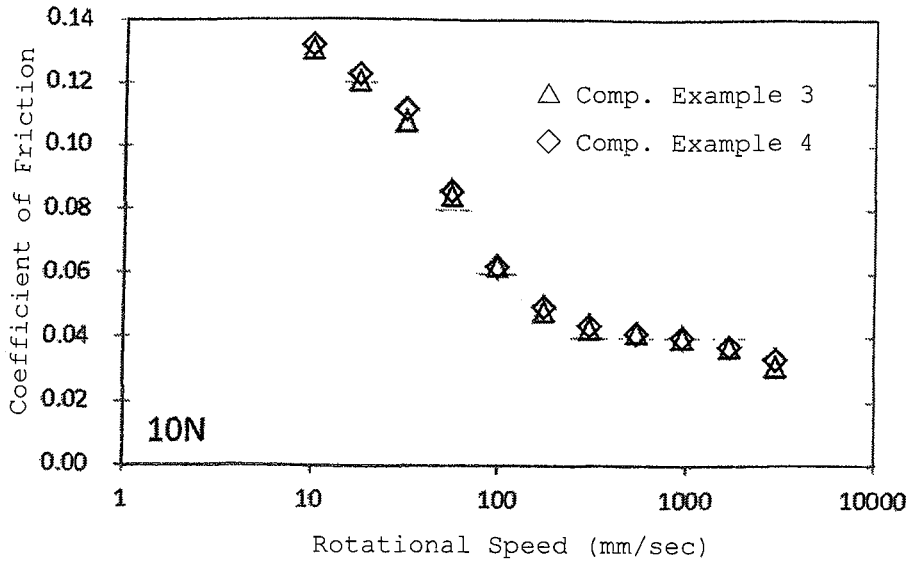
FIG. 9 is a graph for showing a coefficient of friction at each revolution number at a temperature of 40° C. and a load of 10 N in a MTM test using a 5W-30 engine oil.
Figure 10:
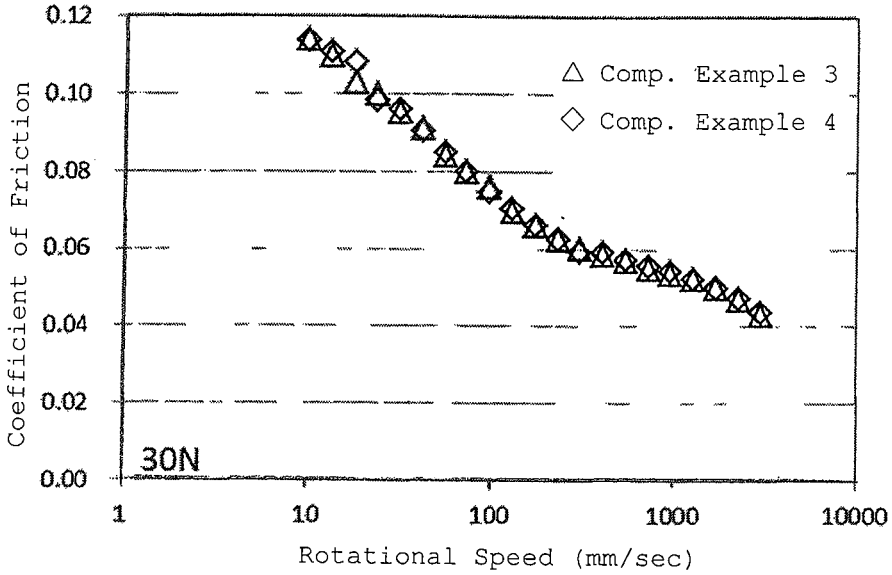
FIG. 10 is a graph for showing a coefficient of friction at each revolution number at a temperature of 40° C. and a load of 30 N in the MTM test using a 5W-30 engine oil.
Figure 11:
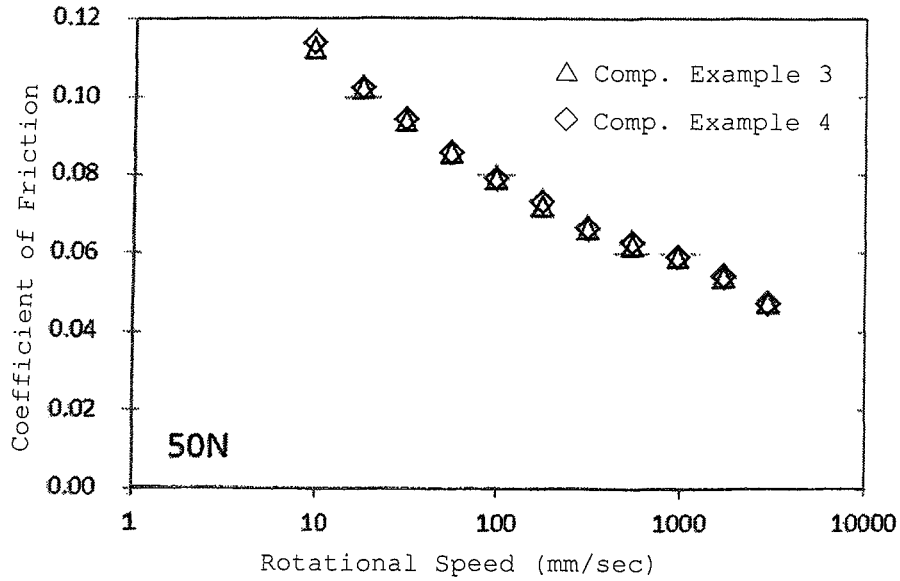
FIG. 11 is a graph for showing a coefficient of friction at each revolution number at a temperature of 40° C. and a load of 50 N in the MTM test using a 5W-30 engine oil.

Further, the test was performed by using the 5W-30 engine oil at a slide-roll ratio (SRR) of 50% and 40° C. The evaluation was performed at a load of 10 N, 30 N, or 50 N, and obtained results are shown in FIG. 9 (load: 10 N), FIG. 10 (load: 30 N), and FIG. 11 (load: 50 N). The axis of abscissa indicates rotational speed (mm/sec), and the axis of ordinate indicates coefficient of friction. As in the above-mentioned evaluation, the effect of the present invention was confirmed by comparing coefficients of friction at a rotational speed of 20 mm/sec. In Table 6, coefficients of friction at a rotational speed of 20 mm/sec at a load of 10 N, a load of 30 N, and a load of 50 N are shown.

TABLE 6

| | Comp. Example 3 Engine Oil Composition 6 | Comp. Example 4 Engine Oil Composition 7 | Engine oil alone |
|---|---|---|---|
| Molybdenum compound (A)-1 | 700 | | |
| Molybdenum compound (A)-2 | | | |
| Molybdenum compound (B)' | | 700 | |
| Coefficient of friction 10 N | 0.120 | 0.122 | 0.121 |

TABLE 6-continued

| | Comp. Example 3 Engine Oil Composition 6 | Comp. Example 4 Engine Oil Composition 7 | Engine oil alone |
|---|---|---|---|
| Coefficient of friction 30 N | 0.103 | 0.108 | 0.109 |
| Coefficient of friction 50 N | 0.102 | 0.102 | 0.103 |

It was found from the above-mentioned results that, in the evaluation in the 5W-30 engine oil deviating from the scope of the present invention, the engine oil composition blended with the molybdenum compound (A)-1 only exhibited performance comparable to that of the engine oil composition blended only with the molybdenum compound (B)' that had heretofore been used in an evaluation at any load.

Figure 12:
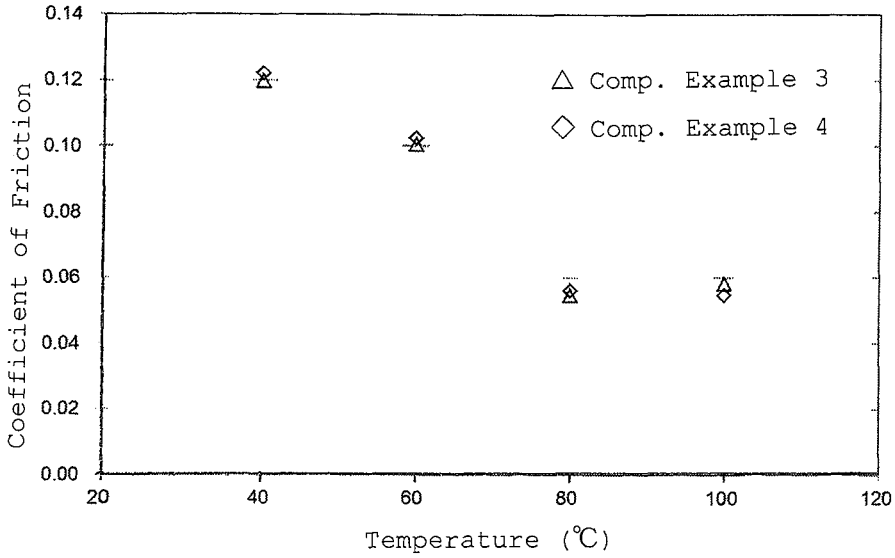
FIG. 12 is a graph for showing a coefficient of friction at each temperature at a rotational speed of 20 mm/sec and a load of 10 N in a MTM test using a 5W-30 engine oil.

Subsequently, as in the 0W-16 and 0W-12 engine oils, an influence of temperature was also evaluated. A test was performed by using the 5W-30 engine oil at a rotational speed of 20 mm/sec and a load of 10 N. The results are shown in FIG. 12. The axis of abscissa indicates temperature (° C.), and the axis of ordinate indicates coefficient of friction. The results shown in FIG. 12 are shown in numerical values in Table 7.

TABLE 7

| | Comp. Example 3 Engine Oil Composition 6 | Comp. Example 4 Engine Oil Composition 7 | Engine oil alone |
|---|---|---|---|
| Molybdenum compound (A)-1 | 700 | | |
| Molybdenum compound (A)-2 | | | |
| Molybdenum compound (B)' | | 700 | |
| Coefficient of friction at 40° C. | 0.120 | 0.122 | 0.121 |
| Coefficient of friction at 60° C. | 0.100 | 0.102 | 0.110 |
| Coefficient of friction at 80° C. | 0.055 | 0.056 | 0.114 |
| Coefficient of friction at 100° C. | 0.058 | 0.055 | 0.106 |

It is found from the above-mentioned results that, in the evaluation in the 5W-30 engine oil deviating from the scope of the present invention, the engine oil composition blended with the molybdenum compound (A)-1 only exhibits performance comparable to that of the engine oil composition blended only with the molybdenum compound (B)' that has heretofore been used.

<Lubrication Characteristic Evaluation (II)>

Further, a lubrication characteristic evaluation (II) was performed by using the engine oil compositions shown in Table 1. In the test, the measurement of torque was performed with a test engine [2ZR-FE (inline-four 1.8-liter engine) manufactured by Toyota Motor Corporation]. The evaluation was based on the measurement results of an engine oil alone free of any molybdenum compound, and was performed by comparing torque reduction ratios (%) with respect thereto. The larger the torque reduction ratio (%) the greater the friction-reducing effect of the engine oil composition.

Evaluation in 0W-16 Engine Oil

Figure 13:
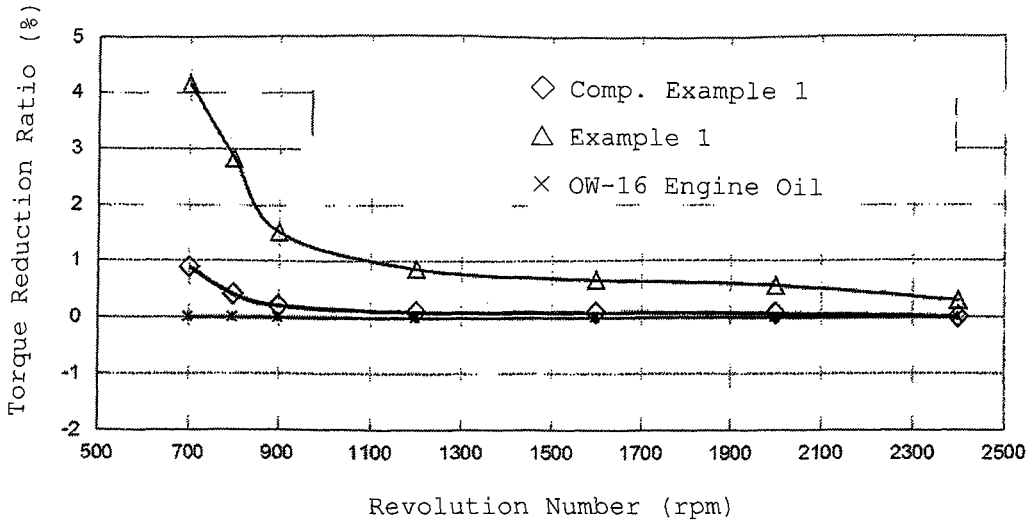
FIG. 13 is a graph for showing a torque reduction ratio (%) with respect to an engine revolution number in a 0W-16 engine oil.

The test was performed by using the 0W-16 engine oil. The test temperature was 80° C., and results obtained by measuring torque values at the respective revolution numbers are shown in FIG. 13. The axis of abscissa indicates engine revolution number (rpm), and the axis of ordinate indicates torque reduction ratio (%) based on the measured value of the engine oil alone free of any molybdenum compound. Torque reduction ratios (%) at low engine revolution numbers are evaluation results in a region where lubrication conditions are severe, and hence the effect of the present invention was confirmed by comparing torque reduction ratios (%) at a revolution number of 700 rpm. The numerical values are shown in Table 8.

TABLE 8

| | Example 1 Engine Oil Composition 1 | Comp. Example 1 Engine Oil Composition 4 |
|---|---|---|
| Molybdenum compound (A)-1 | 700 | |
| Molybdenum compound (A)-2 | | |
| Molybdenum compound (B)' | | 700 |
| Torque reduction ratio at 700 rpm (%) | 4.156 | 0.883 |

It was found from the above-mentioned results that, even in the torque test, the engine oil composition of the present invention exhibited a friction-reducing effect superior to that of the engine oil composition blended only with the molybdenum compound (B)' (Comparative Example 1) that had heretofore been used.

INDUSTRIAL APPLICABILITY

The engine oil composition of the present invention can be said to be a fuel-saving-type engine oil composition that exhibits a satisfactory friction-reducing effect in a low-viscosity engine oil without being constrained by, for example, high temperatures, low temperatures, low loads, or high loads. In addition, the additive for an engine oil of the present invention can be said to be an additive for an engine oil that reduces the coefficient of friction without being affected by environmental constraints, such as high temperatures, low temperatures, low loads, or high loads, when added to an engine oil having a low-temperature viscosity of from 0 to 10 in the SAE viscosity grades and a high-temperature viscosity of from 4 to 20 in the SAE viscosity grades. The development of an engine oil and an additive for an engine oil each of which is not affected by any environment in an engine has been strongly required from the market, and the oil and the additive can be expected to find use in various vehicles. Accordingly, the usefulness of the present invention is extremely high.

The invention claimed is:

1. An engine oil composition, comprising:

an engine oil having a low-temperature viscosity of from 0 to 5 in SAE viscosity grades and a high-temperature viscosity of from 8 to 16 in the SAE viscosity grades; and a molybdenum compound (A) represented by the following formula (1):

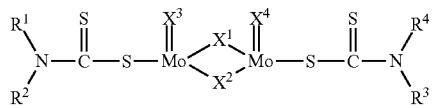

(1)

where $R^1$ and $R^4$ represent the same hydrocarbon group, $R^2$ and $R^3$ represent the same hydrocarbon group and are different from that represented by $R^1$ and $R^4$, and any two of $R^1$ to $R^4$ represent a 2-ethylhexyl group and an isodecyl group, or represent a 2-ethylhexyl group and an isotridecyl group, and $X^1$ to $X^4$ each independently represent a sulfur atom or an oxygen atom, and wherein a molybdenum content in the engine oil composition is from 500 ppm by mass to 1,000 ppm by mass.

2. The engine oil composition according to claim 1, further comprising a molybdenum compound (B) represented by the following formula (2):

(2)

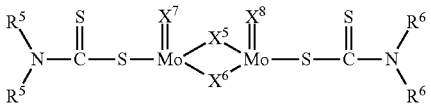

where $R^5$ and $R^6$ each independently represent a hydrocarbon group having 4 to 18 carbon atoms, and $X^5$ to $X^8$ each independently represent a sulfur atom or an oxygen atom.

3. A method of reducing a coefficient of friction of an engine oil, comprising adding an additive for an engine oil containing a molybdenum compound (A) represented by the following formula (1) to an engine oil having a low-temperature viscosity of from 0 to 5 in SAE viscosity grades and a high-temperature viscosity of from 8 to 16 in the SAE viscosity grades:

(1)

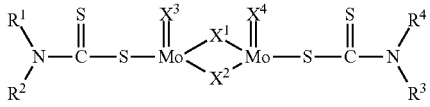

where $R^1$ and $R^4$ represent the same hydrocarbon group, $R^2$ and $R^3$ represent the same hydrocarbon group and are different from that represented by $R^1$ and $R^4$, and any two of $R^1$ to $R^4$ represent a 2-ethylhexyl group and an isodecyl group, or represent a 2-ethylhexyl group and an isotridecyl group, and $X^1$ to $X^4$ each independently represent a sulfur atom or an oxygen atom, and wherein a molybdenum content relative to a total of the engine oil and the additive is from 500 ppm by mass to 1,000 ppm by mass.

* * * * *